US005610365A

United States Patent [19]

Thiesen

[11] Patent Number: 5,610,365

[45] Date of Patent: Mar. 11, 1997

[54] CARTRIDGE AMMUNITION HAVING A CASE, AN ARROW PROJECTILE AND AN IGNITER-COATED PROPELLANT

[75] Inventor: Stefan Thiesen, Willich, Germany

[73] Assignee: Rheinmetall Industrie GmbH, Ratingen, Germany

[21] Appl. No.: 576,587

[22] Filed: Dec. 21, 1995

[30] Foreign Application Priority Data

Dec. 22, 1994 [DE] Germany ..... 44 45 990.4

[51] Int. Cl.[6] ..... F42B 5/18; F42B 5/26

[52] U.S. Cl. ..... 102/431; 102/289; 102/292; 102/430; 102/439; 102/470

[58] Field of Search ..... 102/202, 289, 102/292, 430, 431, 433, 434, 439, 469, 470, 521, 700

[56] References Cited

U.S. PATENT DOCUMENTS

| | | | |
|---|---|---|---|
| 186,460 | 1/1877 | Buffington | 102/470 |
| 1,354,640 | 10/1920 | Woodbridges, Jr. | 102/289 |
| 4,089,716 | 1/1978 | Gaddard et al. | 149/10 |
| 4,444,115 | 4/1984 | Romer et al. | 102/430 |
| 4,671,179 | 6/1987 | Synofzik et al. | 102/430 |
| 4,763,577 | 8/1988 | Romer et al. | 102/430 |
| 5,192,829 | 3/1993 | Suire | 102/439 |
| 5,325,785 | 1/1994 | Gardner | 102/430 |
| 5,400,714 | 3/1995 | Thiesen et al. | 102/431 |

FOREIGN PATENT DOCUMENTS

| | | | |
|---|---|---|---|
| 77831 | 8/1919 | Austria | 102/430 |
| 428074 | 5/1991 | European Pat. Off. | 102/430 |
| 3701145 | 8/1987 | Germany | 102/470 |
| 4223735 | 1/1994 | Germany | 102/470 |

*Primary Examiner*—Harold J. Tudor
*Attorney, Agent, or Firm*—Spencer & Frank

[57] ABSTRACT

A cartridge ammunition includes a case having a case bottom; a propellant powder disposed in the case, a propellant igniter mounted centrally on the case bottom; and an arrow projectile having a rear length portion extending into the case towards the case bottom. At least those grains of the propellant powder which are situated axially beyond the propellant igniter are coated with an igniting substance.

6 Claims, 2 Drawing Sheets

CARTRIDGE AMMUNITION HAVING A CASE, AN ARROW PROJECTILE AND AN IGNITER-COATED PROPELLANT

BACKGROUND OF THE INVENTION

This invention relates to a cartridge ammunition having a case and an arrow projectile. The case contains a propellant powder and has a propellant igniter arranged centrally on the case bottom. The rear portion of the arrow projectile extends into the case and is separated by a gap from the forward end of the propellant igniter.

For increasing the power of arrow projectiles (kinetic-energy penetrators) a possibly large length/diameter ratio of the arrow projectile is sought. Since the length of the cartridge is predetermined, for example, by the available weapons, the arrow projectile can be lengthened only by prolonging it at its bottom side, inwardly of the case. Such a solution, however, affects the length of the propellant igniter which extends axially from the case bottom so that often insufficient space remains available for a ballistically secure ignition of the propellant powder.

German Offenlegungsschrift (application published without examination) 41 05 255 discloses an arrow projectile cartridge in which, for ensuring a sufficient length of the projectile igniter, several igniting tubes, having radial openings, are provided in the axial direction about the rearward portion of the projectile.

It is a disadvantage of the known cartridges that, among others, the assembly and material outlay is relatively high because to ensure a uniform projectile combustion and a satisfactory ignition, at least four igniting tubes have to be arranged uniformly about the rear part of the projectile.

SUMMARY OF THE INVENTION

It is an object of the invention to provide an improved cartridge ammunition of the above-outlined type in which a secure ignition of the propellant powder and a uniform propellant combustion are achieved in a simple manner even in case of a deep penetration of the arrow projectile into the case.

This object and others to become apparent as the specification progresses, are accomplished by the invention, according to which, briefly stated, the cartridge ammunition includes a case having a case bottom; a propellant powder disposed in the case; a propellant igniter mounted centrally on the case bottom; and an arrow projectile having a rear length portion extending into the case towards the case bottom. At least those grains of the propellant powder which are situated axially beyond the propellant igniter are coated with an igniting substance.

Essentially, the invention is based on the principle to provide at least that portion of the propellant powder which is situated beyond propellant igniter with a coating of an igniting substance which may be identical to the material used in the propellant igniter. This measure ensures a rapid overall ignition of the propellant, so that the known central propellant igniter may dispensed with in most cases. The coating of the individual propellant grains is carried out in a separate process, prior to filling the propellant powder into the cartridge case.

It is a further advantage of the cartridge ammunition according to the invention that when using a combustible case Jacket and a non-combustible case bottom, the length of the propellant igniter may be selected such that the propellant igniter—together with the usually metal igniting tube—does not project beyond the edge of the case bottom, that is, it does not project out of the space defined by the lateral case bottom wall. In this manner, in addition to increasing the power of the arrow projectile, the handling of the case bottom subsequent to firing is significantly facilitated because no metal parts project beyond the case bottom.

DESCRIPTION OF THE PREFERRED EMBODIMENT

Figure 1:
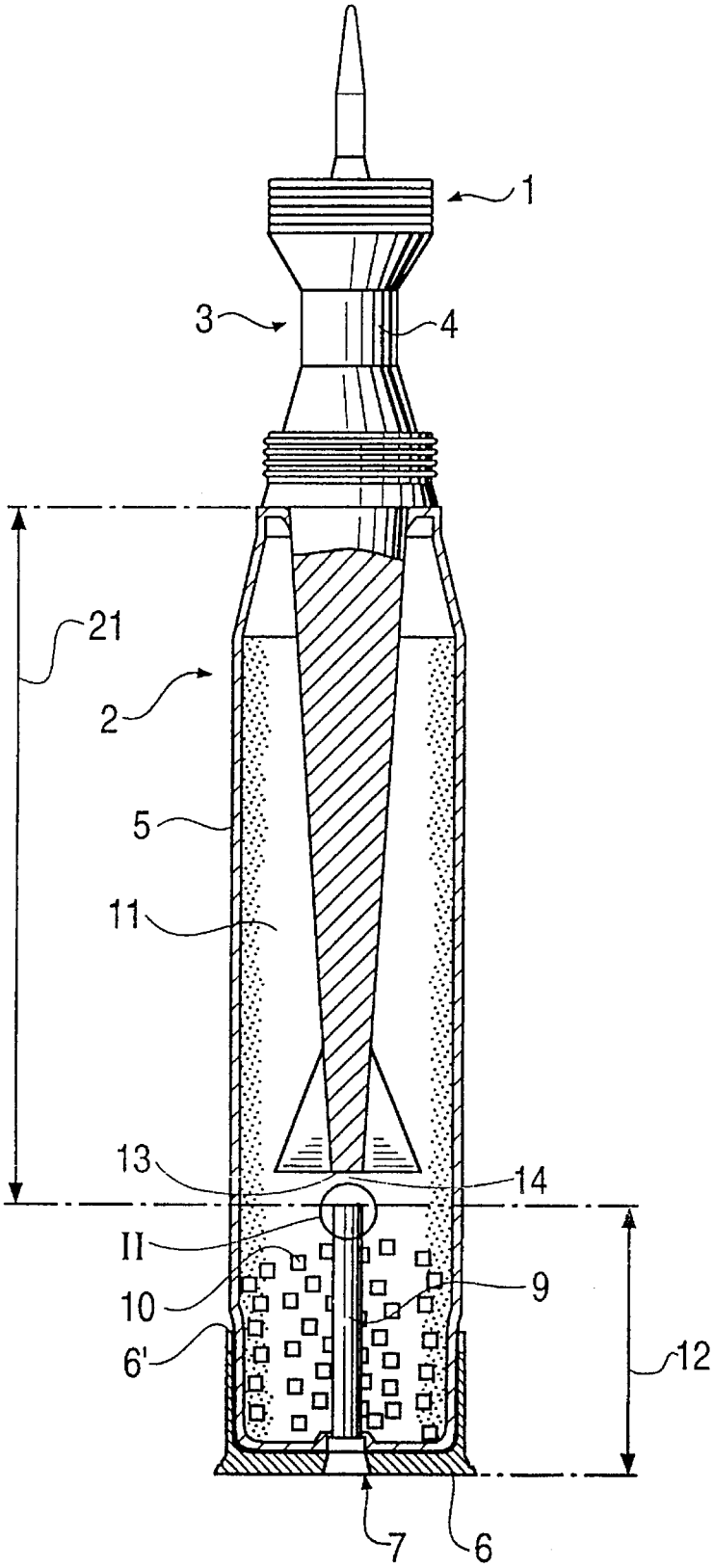
FIG. 1 is an axial sectional view of an arrow projectile cartridge incorporating the invention.

Turning to FIG. 1, there is illustrated therein a cartridge ammunition generally designated at 1 which essentially has a case 2 and a subcaliber arrow projectile 3 including a sabot 4.

Figure 2:
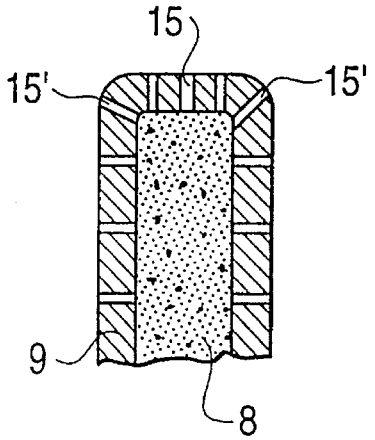
FIG. 2 is an enlarged sectional side elevational view of the inset II of FIG. 1.

The case 2 is formed of a case Jacket 5 made of combustible material and a case bottom 6 made of metal and having a lateral wall terminating at an upper wall edge 6'. In the center of the case bottom 6 a propellant igniter 7 is held by a threaded connection; the igniting tube 9 (FIG. 2) of the propellant igniter 7, filled with an igniting substance 8, extends axially within the inner chamber 11 of the case 2. The inner chamber 11 is filled with propellant powder (principal propellant) 10. The length 12 of the propellant igniter 7 is so selected that between the rear terminus 13 of the arrow projectile 3 and the oppositely located forward end of the igniting tube 9 a clearance 14 remains. Further, the igniting tube 9 has at its forward end oriented towards the rear terminus 13 of the arrow projectile 3, axially-oriented apertures 15 as well as obliquely-oriented apertures 15'.

Figure 3:
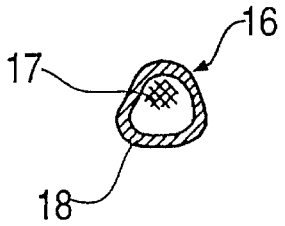
FIG. 3 is a sectional view of a propellant-powder grain coated with an igniting substance according to the invention.

In FIG. 3 a propellant-powder grain 17 is illustrated which, according to the invention, is coated with an igniting substance 18. The coated grain is generally designated at 16.

It is feasible to coat either all propellant grains of the principal propellant 10, or to coat only those grains which are situated axially beyond the igniting tube 9, that is, those grains which are located in the zone designated at 21 in FIG. 1. The use of coated propellant grains only above the igniting tube 9 has the advantage that less coated powder needs to be used. In the zone of the igniting tube 9 there occurs then an ignition solely by means of the propellant igniter 7 which, as a rule, is sufficient.

Upon firing the cartridge i from a non-illustrated weapon, the propellant igniter 7 and thus the igniting substance S in the igniting tube 9 is ignited. Igniting flames which pass through the apertures 15, 15' of the igniting tube 9 impinge at least partially upon the igniting substance 18 of the propellant-powder grains surrounding the propellant igniter 7 and thereafter effect an ignition of the remaining coated powder grains. The rapidly progressing igniting flame ignites the entire principal propellant 10 surrounding the projectile 3.

As an igniting substance 18 either a porous igniting/propellant powder or a pyrotechnical lacquer (for example, black powder dissolved in nitrocellulose lacquer) may be used. Such a coating is characterized by a high and substantially pressure-independent flame expansion velocity (linear burning speed). For example the coating is done by spraying.

Figure 4:
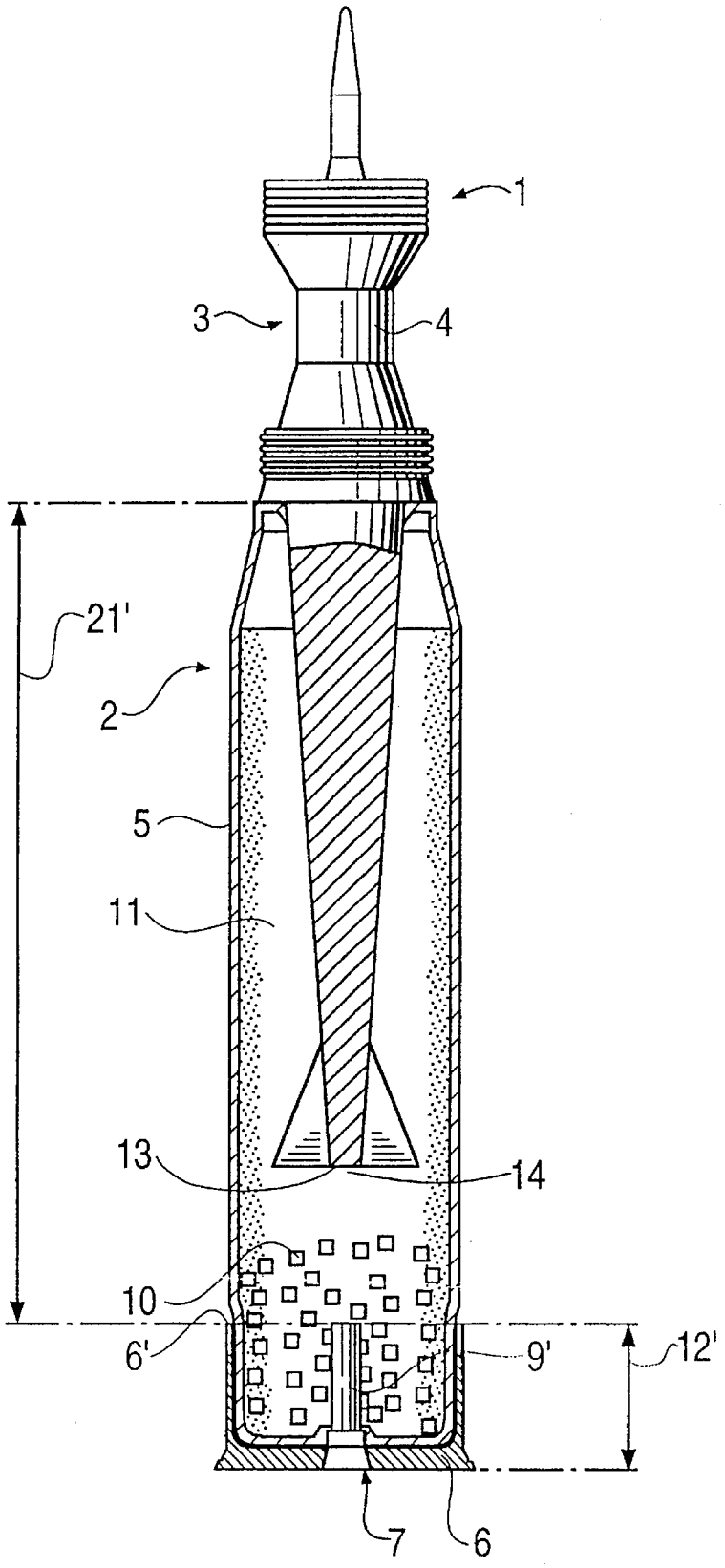
FIG. 4 is a other axial sectional view with a short igniter tube

Turning to FIG. 4, in case the jacket 5 is of a combustible material and the case bottom 6 is of a non-combustible substance, the height of the side wall of the case bottom 6 (that is, the location of the upper edge 6') and the length of the igniting tube 9' are so selected that the igniting tube 9' is situated in its entirety in the space surrounded by the wall of the case bottom 6. Such an arrangement significantly facilitates the handling of the case bottom subsequent to firing, since the tube 9' does not project beyond the wall perimeter defined by the edge 6'.

It will be understood that the above description of the present invention is susceptible to various modifications, changes and adaptations, and the same are intended to be comprehended within the meaning and range of equivalents of the appended claims.

What is claimed is:

1. A cartridge ammunition comprising (a) a case including a case bottom;

(b) an arrow projectile having a rear length portion extending into said case towards said case bottom;

(c) a propellant igniter mounted centrally on said case bottom; said propellant igniter including an igniting tube filled with an igniting substance; said igniting tube extending from said case bottom toward said arrow projectile; said igniting tube having a part oriented toward a rear terminus of said rear length portion; said part of said igniting tube being provided with axially and obliquely oriented apertures;

(d) propellant-powder grains disposed in said case; and (e) a coating of igniting substance applied to at least those grains in said case that are located beyond said igniting tube.

2. The cartridge ammunition as defined in claim 1, wherein said coating of igniting substance comprises a porous igniting propellant powder.

3. The cartridge ammunition as defined in claim 1, wherein said coating of igniting substance comprises a pyrotechnical lacquer.

4. The cartridge ammunition as defined in claim 1, wherein said case is combustible and said case bottom is non-combustible; said case bottom having a side wall terminating in a frontal or upper edge; said igniting tube being situated entirely within a surface defined by said side wall and bounded by said upper edge.

5. The cartridge ammunition as defined in claim 1, wherein all said propellant-powder grains carry said coating of igniting substance.

6. The cartridge ammunition as define in claim 1, wherein the grains provided with said igniting substance are located solely beyond said igniting tube.

* * * * *